US005496122A

United States Patent [19]

Fattori

[11] Patent Number: 5,496,122

[45] Date of Patent: Mar. 5, 1996

[54] REPLACEABLE STICK DEODORANT PACKAGE

[75] Inventor: Joseph E. Fattori, Mendham, N.J.

[73] Assignee: The Mennen Company, Morristown, N.J.

[21] Appl. No.: 158,379

[22] Filed: Nov. 29, 1993

Related U.S. Application Data

[63] Continuation of Ser. No. 942,798, Sep. 10, 1992, abandoned.

[51] Int. Cl.[6] ..... A45D 40/00; A45D 40/16

[52] U.S. Cl. ..... 401/98; 401/78; 401/88; 401/49

[58] Field of Search ..... 461/49, 55, 56, 461/75, 78, 82, 85–90, 98, 172–175

[56] References Cited

U.S. PATENT DOCUMENTS

| | | | |
|---|---|---|---|
| 1,018,949 | 2/1912 | Williams . | |
| 1,238,744 | 9/1917 | Colgate . | |
| 2,485,320 | 10/1949 | Rosenthal | 401/89 |
| 3,100,363 | 8/1963 | Staver | 401/88 |
| 3,443,874 | 5/1969 | Pelli et al. | 401/55 X |
| 3,589,821 | 6/1971 | Barney | 401/175 X |
| 4,235,557 | 11/1980 | Hayes | 401/49 |
| 4,298,036 | 11/1981 | Horvath | 141/1 |
| 4,605,330 | 8/1986 | Crowly et al. | 401/75 X |
| 4,621,934 | 11/1986 | Starek . | |
| 4,700,448 | 10/1987 | Parker | 401/98 X |
| 4,702,399 | 10/1987 | Davis | 401/75 X |
| 4,728,210 | 3/1988 | Barish et al. . | |
| 4,775,256 | 10/1988 | Roth . | |
| 4,890,944 | 1/1990 | Cousins et al. | 401/98 |
| 4,915,234 | 4/1990 | Boeller | 401/98 X |
| 5,109,879 | 5/1992 | Seidler | 132/320 |
| 5,326,185 | 7/1994 | Dornbusch et al. | 401/98 X |

FOREIGN PATENT DOCUMENTS

| | | | |
|---|---|---|---|
| 538021 | 7/1921 | France . | |
| 1250404 | 2/1956 | France | 401/78 |
| 1003411 | 2/1957 | Germany | 401/82 |
| 2807472 | 8/1979 | Germany | 401/75 |

*Primary Examiner*—Danton D. DeMille
*Attorney, Agent, or Firm*—Antonelli, Terry, Stout & Kraus

[57] ABSTRACT

Disclosed is a package for a solid stick product (e.g., antiperspirant or deodorant product), wherein the product is completely exposed on a retaining member so as not to require an elevating mechanism. The package has three components: a cover, the retaining member and a handle. The handle is removably connected to the retaining member, so that upon using up the product on the retaining member the handle can be removed and attached to another retaining member filled with product (which is, e.g., sold as a refill assembly). Molten product is filled through a fill hole in the retaining member into a cavity defined between the retaining member and cover; the retaining member has bosses for anchoring the product on the retaining member, and has vent channels extending between the bosses and the fill hole to displace trapped air from the bosses when filling the cavity. The cover has a vent hole (which is covered when filling the cavity with molten product) to facilitate removal and application of the cover to the retaining member.

34 Claims, 8 Drawing Sheets

REPLACEABLE STICK DEODORANT PACKAGE

This application is a Continuation application of application Ser. No. 07/942,798, filed Sep. 10, 1992, now abandoned.

BACKGROUND OF THE INVENTION

The present invention relates to a package for a solid stick product (for example, a deodorant and/or antiperspirant product for application to human axillary regions, hereinafter referred to as a "deodorant"), and the resulting packaged solid stick product. More specifically, the present invention relates to a package for solid stick products wherein the product is fully exposed for use on a support, which package does not require structure for elevating the product out of the package for use.

It has been desired to provide improved packages for solid stick products, wherein filling of the package with molten (liquified) product (e.g., a hot-fill solid product) is simplified, and wherein the package itself is simple (that is, does not require a mechanism for elevating the product out of a housing, which mechanism increases cost of the package and makes the package more complex).

U.S. Pat. No. 4,235,557 to Hayes, the contents of which are incorporated herein by reference in their entirety, describes such a package wherein a mechanism for elevating the product out of a housing is unnecessary. The package disclosed in U.S. Pat. No. 4,235,557 has a cover; a member for holding the solid stick product for securing the product to the device, such product holder having a hot-fill port and a coupling for selectively attaching the cover to the product holder so that the cover and product holder form a cavity into which the product is hot-filled; and a handle connected to the product holder and extending in a direction substantially opposite the cavity. This patent discloses that it is preferred that the hollow cover have a hemispherical inside surface; and that by utilizing this hemispherical surface the hot-fill product will have a hemispherical shape which provides comfortable application of the product. This patent further discloses that the member for holding the product can have an annular groove, to create resistance to unseating of the product from the product holder due to lateral forces acting on the product when it is being applied by the user. This patent also discloses that the handle has a hollow groove dimensioned to receive in a snap-fit relationship an annular bead which is located on the uppermost portion of the product holder, such snap-fit insuring a tight rigid attachment between the handle and product holder so that these two pieces will be difficult to remove one from the other. This patent goes on to state that it may be desirable to utilize other means for attaching the handle and product holder, such as sonic welding or gluing.

The package according to U.S. Pat. No. 4,235,557 does not need a product elevating mechanism, since the product is always exposed on the product holder.

However, the structure in U.S. Pat. No. 4,235,557 has various disadvantages. For example, upon filling the product into the cavity through the hot-fill port, problems can arise in connection with air within the cavity. Moreover, U.S. Pat. No. 4,235,557 describes a unitary package, with no disclosure as to re-use of any part of the package.

In addition, the package in U.S. Pat. No. 4,235,557 is described as having a cover which is selectively attached to the product holder by way of screwing cooperation between the cover and product holder; and that other selective attachment structure, such as a snap-on/snap-off relationship may be achieved between the cover and product holder. However, this patent provides no description as to facilitating application and/or removal of the cover from the product holder.

U.S. Pat. No. 4,728,210 to Barish, et al discloses a package for application of a solid product (e.g., deodorant, antiperspirant and the like) without the need of an elevating mechanism. The package includes a member (denoted in U.S. Pat. No. 4,728,210 as a "cover" to which the solid product is attached), and a container or base receptacle which covers the solid product held by the member. Such member is provided with a holder for holding the solid product such that the solid product is removed from the container with the member. The structure for retaining the solid product is disclosed in U.S. Pat. No. 4,728,210 as a gripper generally in the form of a support plate, the support plate having a first surface facing the member and a second opposite surface which faces the base receptacle, the solid product extending outwardly from the second surface. This patent discloses that the solid product extends through openings in the support plate into the open space between the support plate and member, covering at least a portion of the first surface of the support plate so as to hold the product. This patent also discloses that the member/container assembly is inverted and molten product is hot-filled through a hole in the member to fill a cavity between the member and container, a plug then being placed in the hole in the member.

U.S. Pat. No. 4,728,210 discloses an integral handle/product retainer, so that when the product is used up the handle and product retainer are both disposed of. Moreover, the product filling the cavity between the support plate and container extends above the support plate, thereby requiring a substantial portion of product that is not available for use. Furthermore, since a relatively large surface area of the solid fill product is exposed above the support plate, problems arise with respect to the product becoming soiled, if the plug is not placed in the member relatively shortly after the hot-fill process.

U.S. Pat. No. 1,238,744 to Colgate discloses a holder for shaving sticks wherein a soap stick, having one end encased in a protective sheet (e.g., of foil), is screwed into an interior member, the interior member being held in an exterior member. After the soap stick has been worn down, the remaining end or remnant of the soap stick may be readily turned out, by unscrewing the wrapped end of the soap stick from the internal member, with a new stick being positioned in the internal member.

U.S. Pat. No. 1,018,949 to Williams discloses a shaving stick holder having an internal shell for holding the stick, the internal shell being within a case and lining. The case and lining have a vent piercing the walls thereof, to permit the escape of air from the case when the shell is pushed home, thereby avoiding the air pushing the shell and stick held therein out of the case.

Notwithstanding the foregoing, it is still desired to provide a package for a solid stick product (for example, a solid stick deodorant for application to human axillary regions) wherein the entire package need not be thrown away after use, such package having the solid product fully exposed without the need of an elevating mechanism. It is also desired to provide a package for a solid stick product which, because the entire package need not be thrown away after use, reduces the plastic waste (is ecologically advantageous)

and reduces the cost of the package. It is also desired to provide a package wherein the cap (cover) can be easily removed and replaced on the product. It is also desired to provide a package which can be easily filled with product by, e.g., a hot-fill procedure; and, in particular, without trapping of air in the package during hot-filling of the product.

SUMMARY OF THE INVENTION

Accordingly, it is an object of the present invention to provide a solid stick product package wherein upon using up the product the entire package need not be thrown away (that is, wherein part of the package can be re-used by the consumer), and to provide a method of using such solid stick product package including re-using a part thereof by the consumer.

It is a further object of the present invention to provide a solid stick product package which reduces the amount of solid waste (e.g., plastic waste) after the product has been used up.

It is a further object of the present invention to provide a solid stick product package wherein the cost of the package, for a given amount of product, is reduced.

It is a still further object of the present invention to provide a refill assembly for use as part of a solid stick product package, such refill assembly containing solid stick product to be incorporated as part of the package.

It is a still further object of the present invention to provide a solid stick product package, wherein the product is firmly held, yet wherein the amount of product not accessible for use is reduced.

It is a still further object of the present invention to provide a packaged solid stick product, and method of filling the package with molten product, wherein the product is filled into a cavity between a retaining member (for retaining the product) and a covering member, while avoiding trapped air in the cavity.

It is a still further object of the present invention to provide a packaged solid stick product, wherein the covering member on the package can be easily removed and replaced.

It is a still further object of the present invention to provide a packaged solid stick product, wherein the top surface of the product, at the time of first use of the product, is shaped so as to be comfortable for the consumer to use.

The foregoing objects are achieved through the package of the present invention, having three components: (1) a cover; (2) a retaining member for retaining the solid stick product thereon; and (3) a handle. The handle can be removed from one retaining member, when the product held by such retaining member has been used up, and fixed on a second retaining member retaining additional product. The cover can also be re-used, on the second retaining member. Since at least the handle can be re-used, solid waste (e.g., plastic waste) resulting after using up solid product in the package can be reduced; this reduction in solid waste is advantageous for the environment. Moreover, by utilizing a handle which can be re-used, the cost of packaging components, for a given amount of product, is reduced.

The foregoing objects are further achieved through use of a retaining member having vent channels therein. Through use of such vent channels, any air trapped in the cavity between the retaining member and covering member, during filling the cavity with product, can be removed from the cavity, so as to avoid air trapped in the solidified product. More specifically, the product can be hot-filled into a cavity between the cover and retaining member, through the retaining member, and any air trapped in the cavity can be removed through the vent channels so as to achieve objectives of the present invention.

In addition, by hot-filling product into the cavity between a covering member and retaining member (especially where the covering member is the bottom member of the covering member/retaining member assembly), and by providing the inside of the covering member with a desired configuration, the top surface of the product can be provided with such desired configuration.

Desirably, the retaining member includes retention bosses (that is, retention wells in relationship to the material) in which product is filled during hot-filling, to anchor solidified product in the retaining member. This provides a structure wherein the retaining member has extra holding power to create resistance to unseating of product due to lateral forces acting on the product when the product is applied by the consumer. Moreover, desirably during the hot-filling molten product passes into a cavity between the covering member and retaining member via a fill hole in the retaining member. The vent channels can traverse between the retention wells and the fill hole, so that air in the retention wells (which become the highest point of the assembly during hot-filling, due to inversion of the covering member and retaining member) can be easily removed through the vent channels.

The objects according to the present invention are further achieved through use of at least one vent hole in the cover. By providing such vent hole in the cover, the cover can easily be applied to the retaining member after use and removed therefrom for use, without there being air pressure differential between the inside and outside of the cover to interfere with application or removal of the cover.

Where a hot-fill procedure is used for filling the cavity between the retaining member and the cover, and the cover has the previously-referred-to vent hole, during filling an adhesive member (e.g., pressure-sensitive adhesive tape or an adhesive label) covers the vent hole (e.g., the outside of the vent hole) to avoid leakage of molten product from the cavity. After the molten product has hardened, such adhesive member can be removed so that the vent hole can function for its intended purpose of facilitating application and/or removal of the cover.

Accordingly, by the present invention, parts of the package can be re-used, reducing solid waste (e.g., plastic waste) resulting from use of the packaged product, which is advantageous to the environment and also reduces packaging costs. Moreover, the package according to the present invention is simple, with reduced component costs especially relative to packages with a product elevating mechanism, including no need for an elevating mechanism for exposing the product. In addition, the cover according to the present invention can easily be removed and/or applied. Furthermore, the top surface of the solid product, which contacts, e.g., the axillary region during use, can be provided with a configuration that is comfortable even upon initial use of the product.

DETAILED DESCRIPTION OF THE INVENTION

Figure 1:
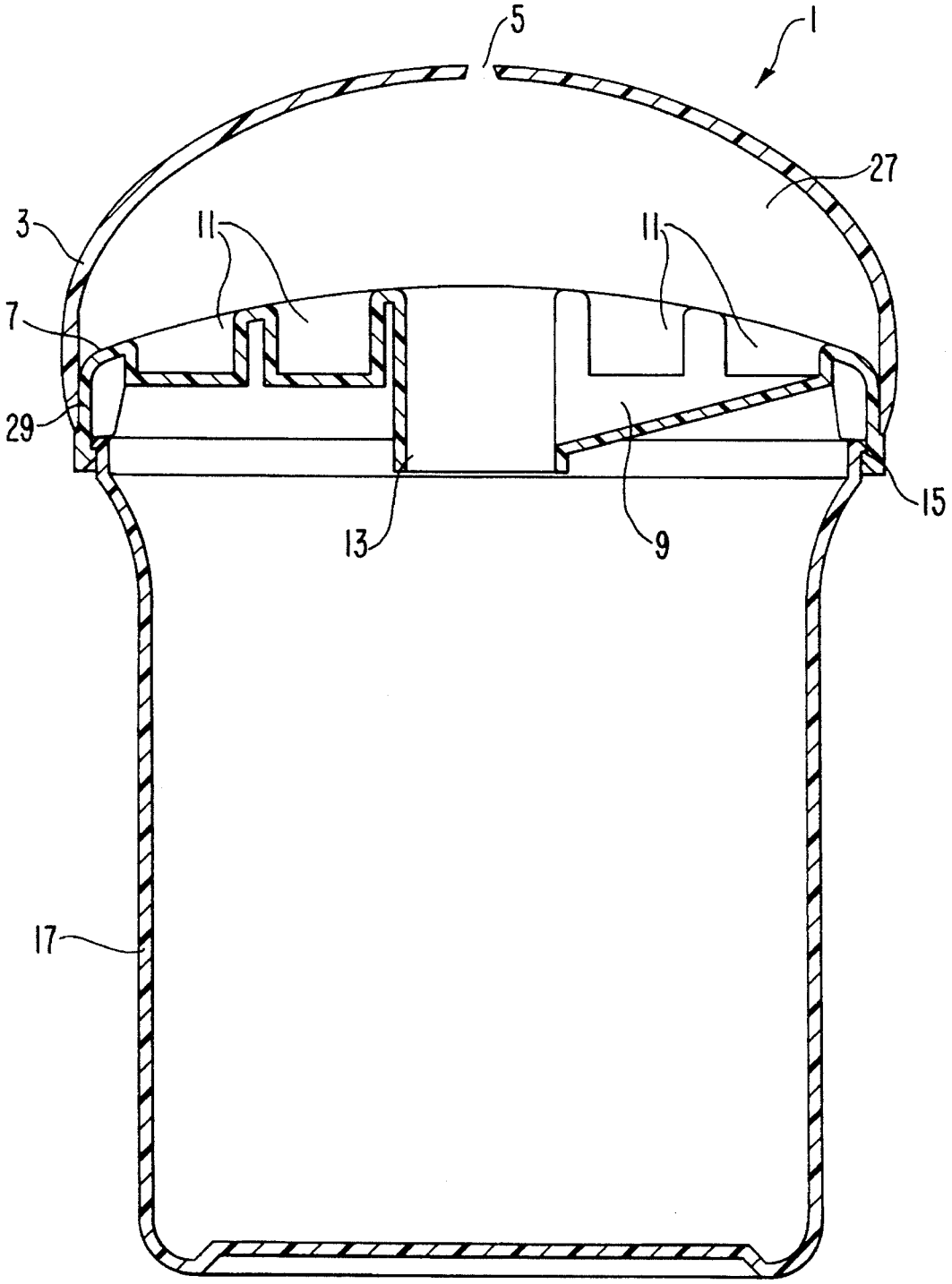
FIG. 1 schematically shows the entire package according to the present invention.

While the invention will be described in connection with specific and preferred embodiments, it will be understood that it is not intended to limit the invention to those embodiments. To the contrary, it is intended to cover all alterations, modifications and equivalents as may be included within the spirit and scope of the invention as defined by the appended claims.

Throughout the present specification, where the package and elements thereof, or method, are described as including or comprising specific components or steps, it is contemplated by the inventor that the package and elements thereof, or method, also consists essentially of, or consists of, the recited components or steps. Accordingly, throughout the present disclosure any described structure or method can consist essentially of, or consist of, the recited components or steps.

The present invention contemplates a package for a solid stick product (for example, a cosmetic stick composition, such as a deodorant and/or antiperspirant stick, but not limited thereto, the present invention also contemplating other types of sticks such as insecticide sticks), a packaged solid stick product, a method of filling such package with the solid stick product, and a method of using the packaged solid stick product. The package as a whole includes three components, namely, a cover, a retaining member (on which the solid stick product is supported), and a handle. The present invention also contemplates a refill assembly comprised of a covering member (which can be the cover) and the retaining member, sold as a unit to be used with a handle (or with a handle and cover). According to the present invention, upon using up a solid stick product retained on a retaining member, the retaining member and handle can be separated from each other; a further retaining member, which is a refill product, can then be attached to the handle; and then such refill assembly product can be used. Through this technique of using the refill assembly, the handle can be re-used, decreasing the solid waste (plastic waste) resulting from using up the solid stick product in a package. Moreover, since portions of the package can be re-used, costs in connection with the packaging components, upon using up the product in a package, can be reduced.

The present invention also contemplates providing a vent hole in the cover of the package, to facilitate removal and application of the cover on the retaining member at each time of use of the product. The vent hole should be sufficiently small so as to avoid substantial amounts of dirt and other foreign matter passing to the solid stick product, yet sufficiently large so that pressure can be equalized inside and outside of the cover so as to ease application and removal of the cover. While illustrative and not limiting of this aspect of the present invention, the vent hole can be circular and have a diameter of 1/16 inch. Preferably, the vent hole is conical with the base of the cone being on the inside of the cover; by having such a vent hole, solidified product formed in the hole will remain as part of the solid product upon removal of the cover. Conversely, if the hole were tapered in the opposite direction (i.e., with the larger area at the outside surface of the cover), solidified product in the hole would separate from the solid product and plug the hole, thereby defeating the purpose of the vent hole unless the hole is unplugged.

The present invention also contemplates a technique for hot-filling the solid stick product into the package, so as to provide the solid stick package, after solidification of the product, with a desired top configuration. Generally, a covering member is provided on the top of the retaining member, so as to provide a cavity between the covering member and the top of the retaining member. Thereafter, the assembly of covering member and retaining member is, e.g., inverted (the retaining member on top) and molten product is passed into the cavity through a fill hole through the retaining member. The top surface of the solid stick product would have the configuration of the inside surface of the covering member, which could be provided with a desired curved configuration.

The present invention also contemplates a retaining member to facilitate hot-filling of the solid stick product. The retaining member has retention wells to be filled with product, to anchor the solidified product on the retaining member, so that upon hardening the product has resistance to lateral forces, e.g., during use of the solid stick product. Moreover, the retaining member has vent channels extending from the wells to the fill hole, so that as the retention wells fill up with molten product any air in the bosses (which, in the inverted retaining member/covering member assembly are highest points of the assembly) will be displaced out of the package.

During filling of the assembly of covering member and retaining member, and where the covering member has a vent hole, the vent hole would be covered with, e.g., a pressure sensitive adhesive member (e.g., an adhesive label) so as to avoid leakage of the molten product through the vent hole. Such pressure-sensitive adhesive member could then be removed at the time of first use by the consumer.

In the following pages are described various embodiments of the present invention, in connection with the accompanying drawing figures. This description is illustrative, and is not limiting of the present invention.

FIG. 1 shows the entire package 1 according to the present invention. The package 1 includes a cover 3, retaining member 7 and handle 17. The cover 3 has a vent hole 5 therein, to facilitate removal and application of the cover on the retaining member 7. As shown in FIG. 1, the vent hole 5 is tapered (e.g., conical) from the inside surface to the outside surface of the cover. The retaining member 7 includes retention wells 11 and a fill hole (fill tube) 13. Extending between the retention wells 11 and fill hole 13 are vent channels 9. The cover 3 is retained on the retaining member at the location indicated by reference number 29 by, e.g., a friction fit. Other means of retention (e.g., corresponding screw threads on the cover and retaining member to screw the cover on the retaining member; or corresponding grooves and projections on the cover and retaining member to provide a snap-fit attachment of the cover on the retaining member) can also be used to retain the cover on the retaining member. The cover and retaining member form therebetween a cavity 27 which is filled with product. The product extends into the retention wells 11, so as to anchor the product on the retaining member and to avoid dislodging of the product from the retaining member by lateral forces, e.g., during use of the product by the consumer.

Attachment between the retaining member and handle is shown at reference number 15 in FIG. 1. Thus, the handle and retaining member respectively have cooperating projecting structure and a groove such that the handle can be snap-fit assembled into the retainer at 15.

Figure 2:
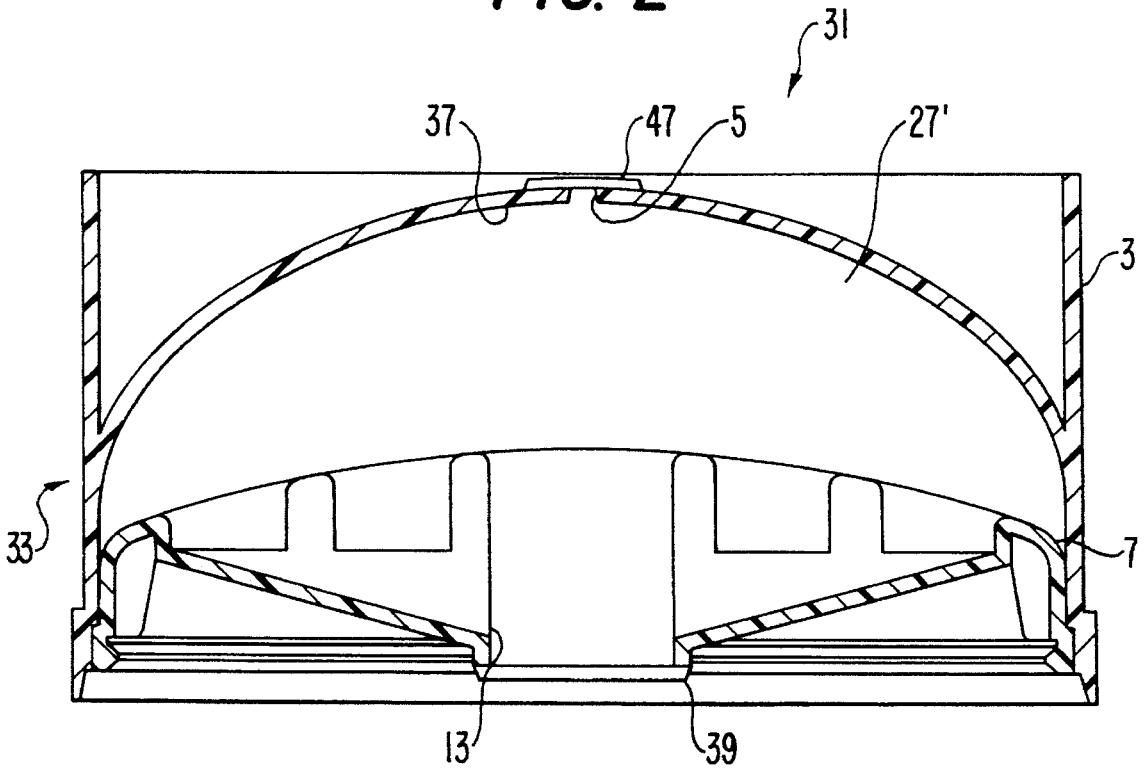
FIG. 2 shows a refill assembly according to the present invention.

FIG. 2 shows the refill assembly 31 according to the present invention. Shown in FIG. 2 is retaining member 7 having thereon covering member 33. Covering member 33 is shown with a vertical, rectangular peripheral wall 35.

Use of this covering member 33 in the refill assembly has various advantages. For one thing, through use of covering member 33, having the peripheral wall 35 which is vertical, a plurality of the products can be stacked on each other. Furthermore, filling of the cavity with molten product, using a covering member 33, is facilitated, as can be seen in the following. Thus, with a cover such as in FIG. 1, upon inverting the assembly the assembly would have to be placed in a carrying puck for filling, the puck positioning the assembly and preventing it from rocking on the ellipsoidal surface of the cover. Through use of the covering member 33 having peripheral vertical wall 35 (which is, for example, rectangular), sufficient stability is provided to the assembly such that there would be no need for carrying pucks during the filling operation.

As can be appreciated, during the filling operation the refill assembly shown in FIG. 2 would be inverted and the cavity 27' between the retaining member 7 and covering member 33 would be filled with molten product, which upon solidifying would take the shape of the inside surface 37 of the covering member 33. During the filling operation, the vent hole 5 is covered with, e.g., adhesive label 47.

Also shown in FIG. 2 is adhesive member 39 (e.g., an adhesive label). This adhesive member desirably is applied over the fill hole 13 after filling molten product therethrough into the cavity 27 or 27' and, e.g., after solidification of the product. This adhesive member would act to prevent dirt from contacting the product in the fill hole in the refill assembly (that is, in the assembly where the handle would not cover the fill hole).

Figure 3:
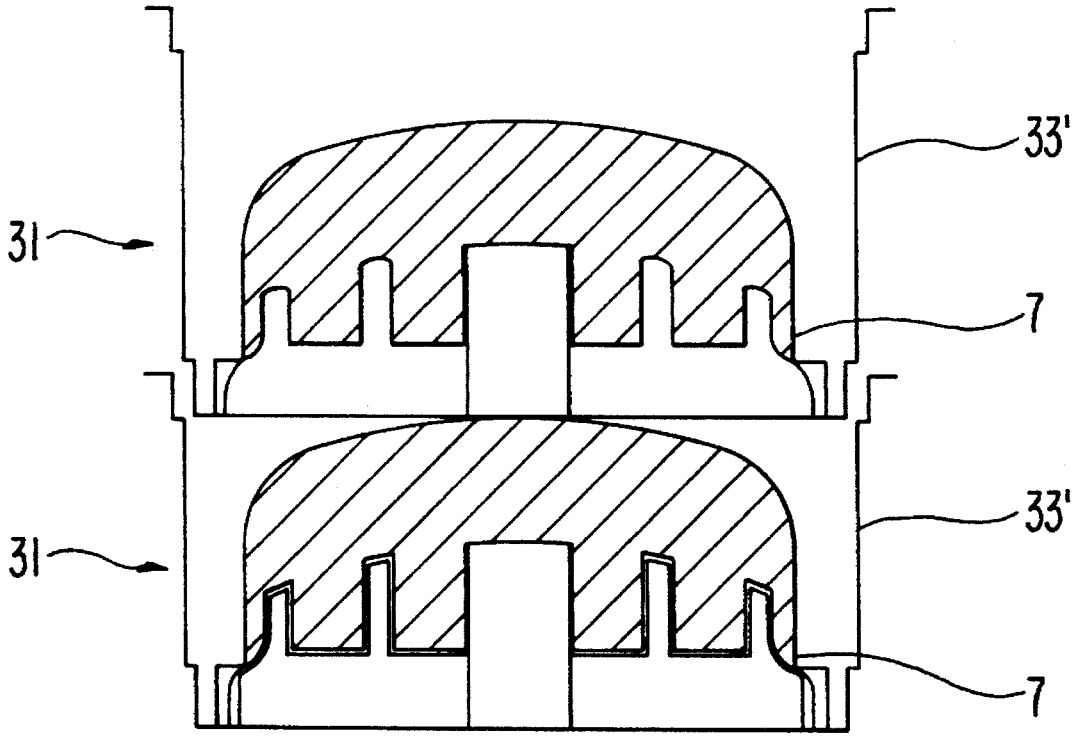
FIG. 3 shows an embodiment of the present invention wherein refill assemblies can be stacked.

FIG. 3 shows stacked refill assemblies according to the present invention. Shown are two refill assemblies 31 each having covering member 33', the covering members having configurations such that the refill assemblies are stackable on each other with good stability.

Figure 4:
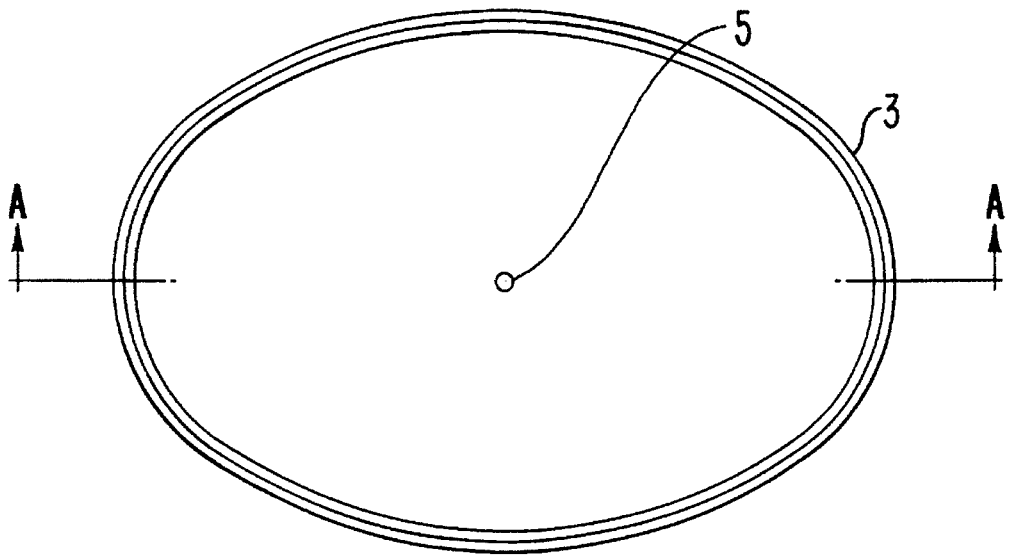
FIGS. 4 and 5 show the cover according to the present invention, respectively in a top view and cross-sectional view, FIG. 5 being a view along line A—A of FIG. 4.
Figure 5:
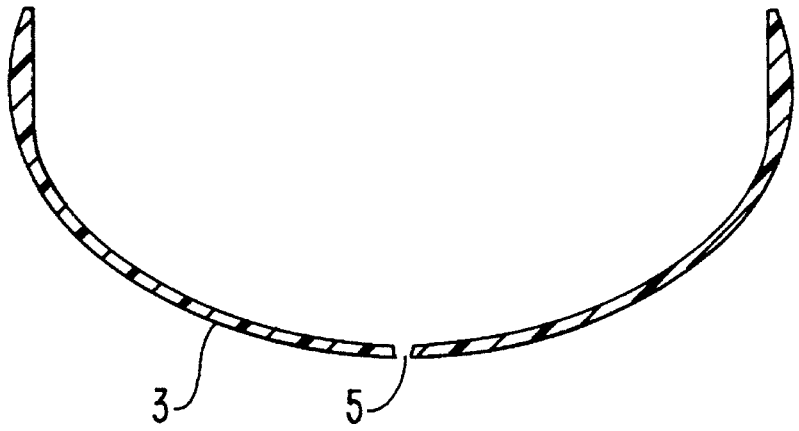

FIGS. 4 and 5 respectively show top and side views respectively of the cover according to the present invention, FIG. 5 being a cross-sectional view along line A—A of FIG. 4. Cover 3 includes vent hole 5, shown as circular in FIG. 4. Of course, the vent hole can have other configurations.

Figure 6:
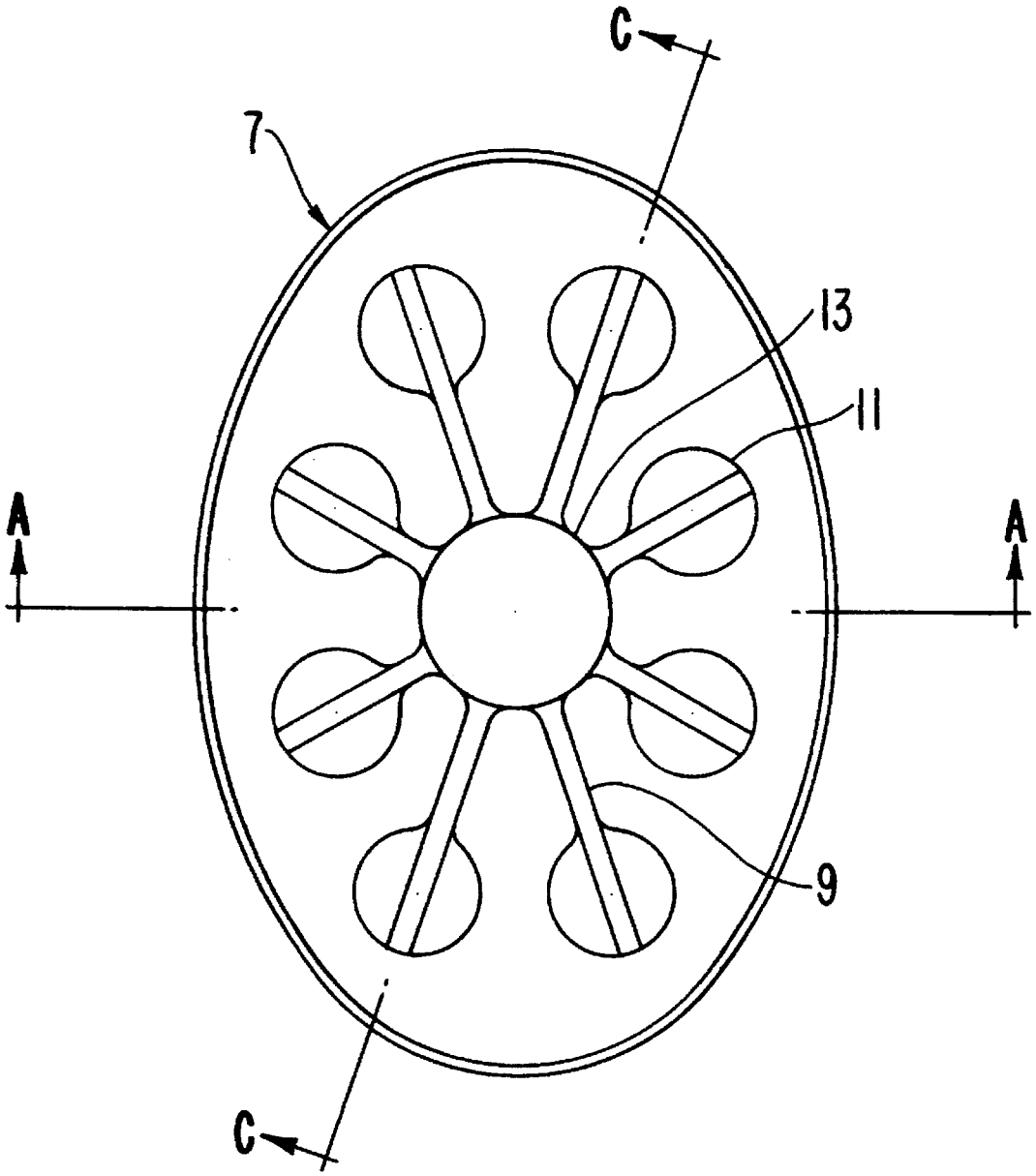
FIG. 6 is a top view of the retaining member.
Figure 7:
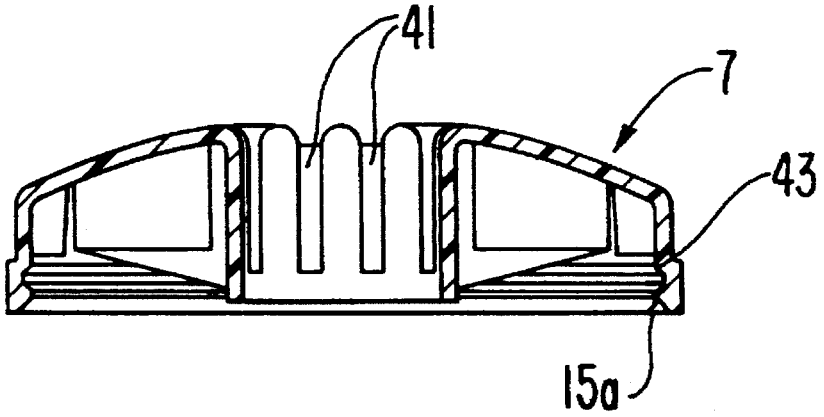
FIGS. 7 and 8 are cross-sectional views of the retaining member, respectively along lines A—A and C—C of FIG. 6.
Figure 8:
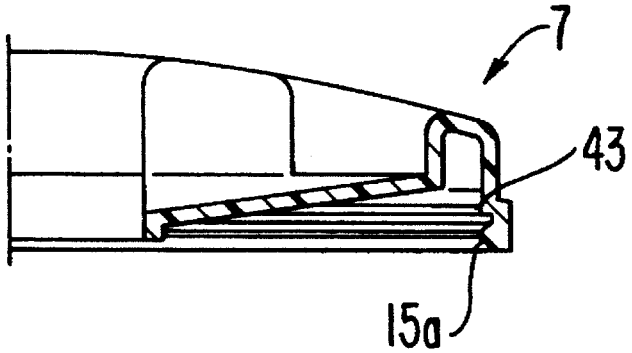

FIGS. 6–8 show the retaining member according to the present invention. Shown in FIG. 6 is a top view of the retaining member 7. The retention wells 11 are shown as surrounding the fill hole 13, which is a central fill hole. The retaining member 7 also includes vent channels 9 extending from the retention wells 11 to the fill hole 13. As seen most clearly in FIG. 7, the vent channels 9 communicate with the fill hole 13 via vent channel openings 41. As can be appreciated from FIG. 6, one vent channel 9 extends from each retention boss 11 to the fill hole 13; however, the present invention is not limited to such structure, and a plurality of vent channels can extend from each retention boss to the fill hole.

Figure 9:
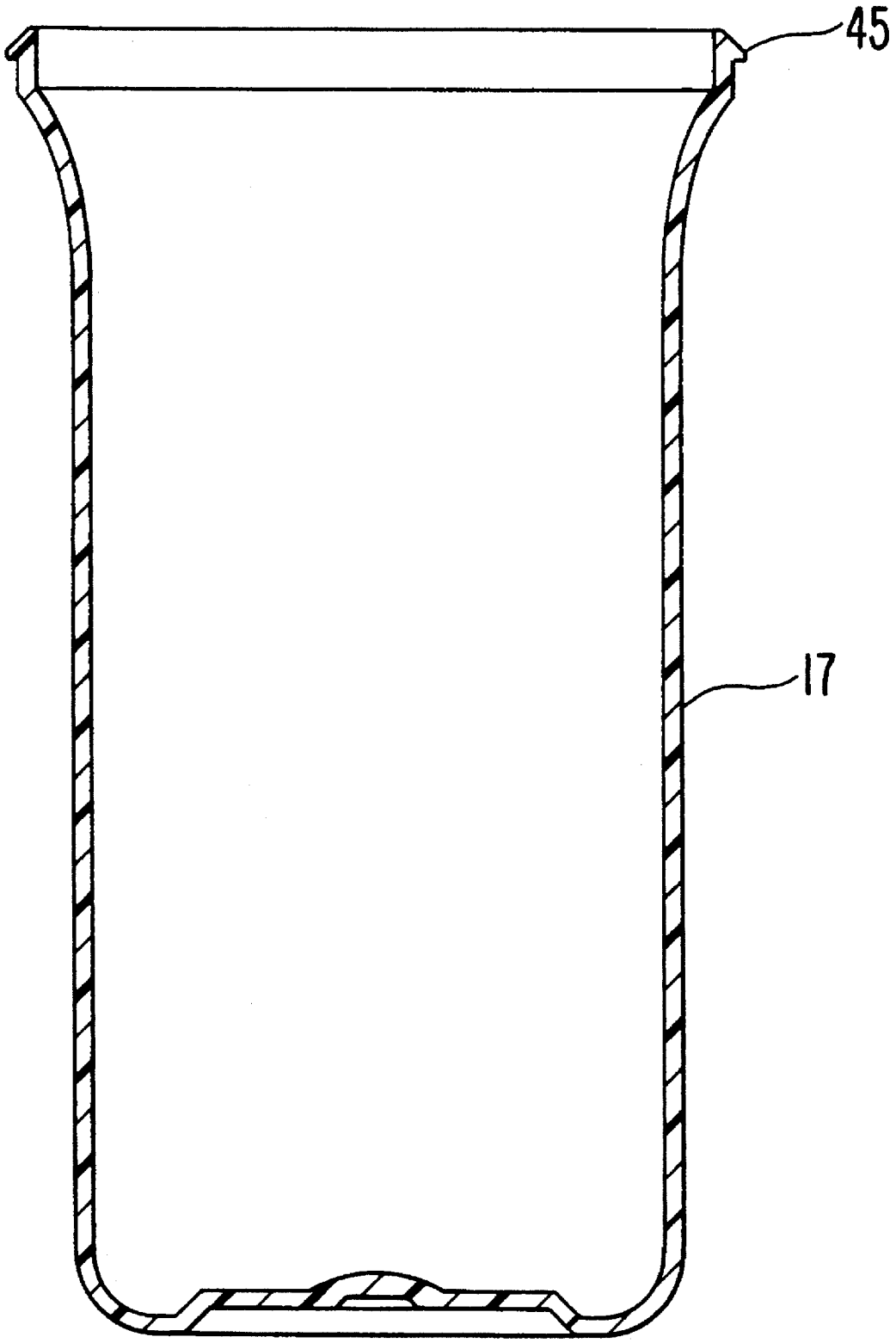
FIG. 9 is a cross-sectional view of the handle.

Shown in FIGS. 7 and 8 is the connecting structure for removably attaching the handle to the retaining member. Shown at 43 in each of FIGS. 7 and 8 is a groove 43 in the inside surface of the retaining member 7, close to the bottom of the retaining member. A projection 45 in the upper periphery of the handle (note FIG. 9) corresponds to the groove 43 and can be snap-fit therein so as to removably attach the handle 17 to the retaining member 7. Note also that the retaining member 7 has a projecting portion **15*a* extending from the bottom of the retaining member 7 and forming a side of the groove 43, to facilitate snap-fit assembly of the projection 45** into the groove.

As seen clearly in FIGS. 1, 7 and 8, the vent channels 9 can each be sloped such that flow of any gases in the retention bosses toward the fill hole would be facilitated. Thus, when the retaining member is inverted, the upper surface of the vent channels at the retention wells is at a lower level than the upper surface of the vent channels at the fill hole. As seen in FIG. 6, the vent channels are open at the surface of the retaining member which supports the solid stick product and which has the retention wells 11 extending therefrom. As seen in FIG. 7, the vent channel openings 41 at the fill hole desirably extend substantially the entire height (with respect to the inverted retaining member) of the fill hole; the vent channel openings at the retention wells (at the opposite end of each vent channel from vent channel openings 41) desirably each extend the entire height (with respect to the inverted retaining member) of the retention wells. As can be appreciated by one of ordinary skill in the art, the vent channels have a sufficient width (e.g., 1/16 inch) such that air trapped in the retention wells can easily flow through the vent channels so as to be removed from the retention wells.

Figure 10:
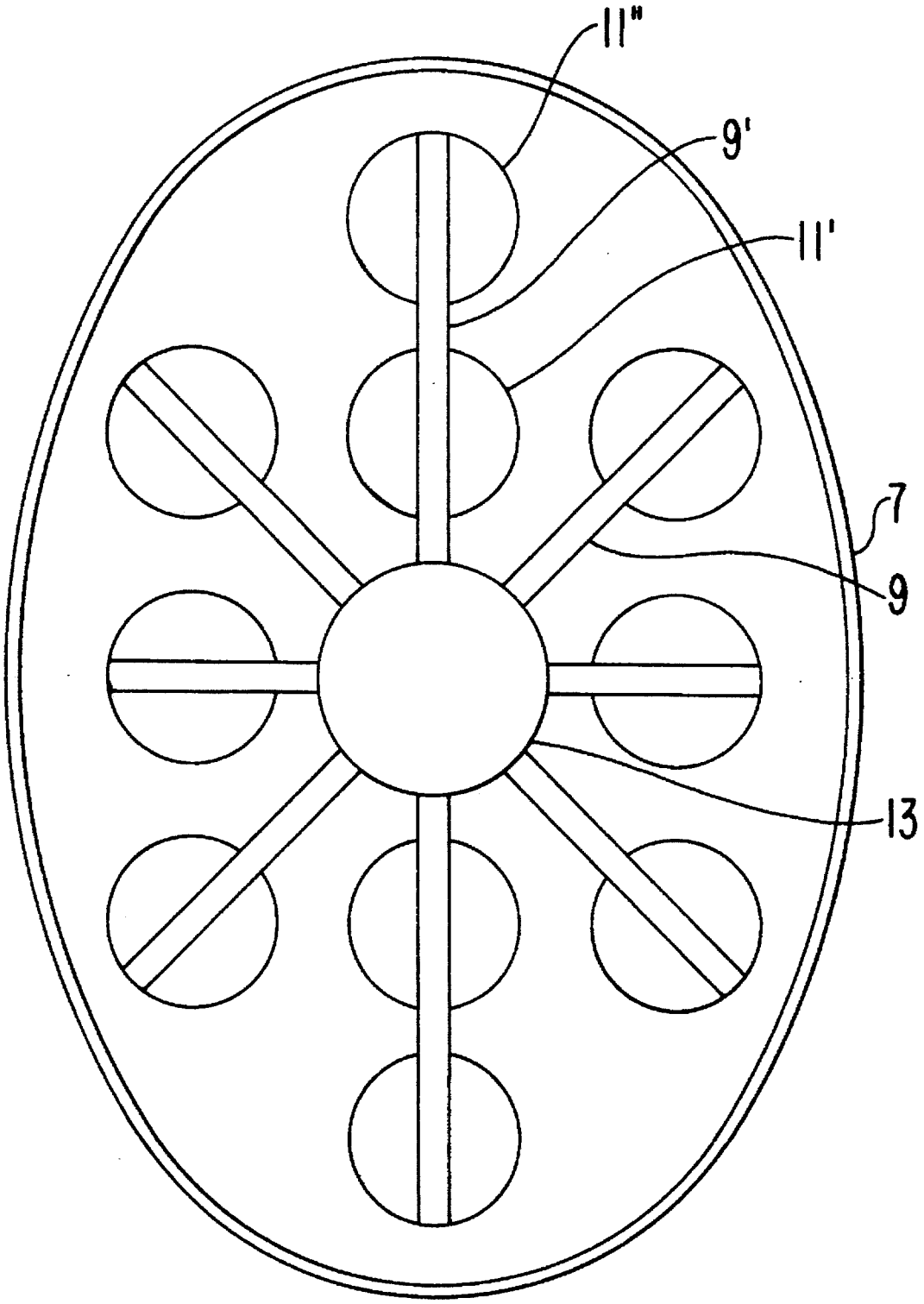
FIG. 10 is a top view of a second embodiment of the retaining member according to the present invention.

FIG. 10 shows a second embodiment of the retaining member 7. This second embodiment has a plurality of retention wells 11 surrounding the fill hole 13 (a central fill hole), with vent channels 9 extending from the retention wells to the fill hole. This second embodiment, shown in FIG. 10, has a single vent channel 9' extending to two wells 11', 11", in the elongated direction of the elliptical retaining member. According to this embodiment, a single vent channel can be utilized for a plurality of retention well, increasing the number of retention wells while avoiding complexity with respect to providing vent channels.

The packaging components (e.g., cover, retaining member and handle) according to the present invention can be made of conventional materials for solid stick product packages (e.g., conventional plastic materials). The packaging components can be made by conventional injection molding techniques, with the material of construction preferably being a thermoplastic material having suitable rigidity to withstand forces which the device will experience when the product is filled by a hot-fill technique into the package and when the consumer uses the product (as well as, e.g., during transportation of the packaged product). Of course, the materials of construction must be able to withstand hot-fill temperatures without deformation. Exemplary of, e.g., thermoplastics which can be used according to the present invention would be polyolefins, having, for example, heat of deformation above about 120° F. The materials discussed herein are merely illustrative, and are not limiting. Illustratively, a polypropylene copolymer can be used for the cover and handle, and high density polyethylene for the retainer.

Filling of the product into the cavity between the cover (covering member) and retaining member can desirably be accomplished as follows. Prior to filling of the assembly of covering member and retainer, the covering member and retaining member are assembled and held together by means of, e.g., a friction fit around the external periphery of the retaining member (shown at 29 in FIG. 1). This friction fit also prevents leakage during filling. The assembly is then inverted and placed in a carrying puck, if necessary, for filling; the puck positions the assembly and prevents it from rocking on the ellipsoidal surface of the cover.

Hot, liquified product is then filled through the fill hole 13 of the retaining member 7, filling the cavity 27 (27') defined by the assembled cover 3 (covering member 33 or 33') and retaining member 7. As the product level rises in the cavity, product enters the multiple retention wells 11, displacing trapped air out through the vent channels 9 and providing an anchor for the product to the package. Filling is completed when the product fill height reaches the bottom surface of the retention wells 11.

After the product has cooled and solidified, the handle 17 can be snap-fit assembled into the retaining member 7 at snap-fit location 15, whereby a complete product of cover, retaining member and handle can be sold to the public.

Of course, and as is clear from the foregoing, after the product has cooled and solidified the assembly of cover (covering member) and retaining member can be packaged and sold by itself, as a refill assembly.

The consumer utilizes the package by removing the cover 3 and applying the product to the underarm. There is no product elevating mechanism for the consumer to use in this package, the entire label weight being accessible for use. When the consumer uses the product down to the ellipsoidal top surface of the retaining member and the product has emptied, the consumer has the option to purchase a refill assembly package or a completely new product package (including handle).

The refill assembly can be made utilizing the covering member 33 (33'), having the vertical peripheral wall 35, which can be decorated, the refill assembly being stacked on store shelves. The refill assembly itself could be inserted into a small carton.

The use of the refill assembly by the consumer requires the consumer to snap-off the retaining member 7 of the used-up product, much like a margarine lid or coffee can lid, and snap the handle 17 into a new retaining member 7 having product thereon. After removing the covering member 33, the consumer is ready to use the product. Moreover, the consumer can retain the original cover 3 from the used-up package and re-use such cover with the new retaining member. Use of the refill, in either case, reduces significantly the amount of package material being disposed after using up the stick product.

Accordingly, by the present invention a solid stick product package (e.g., an antiperspirant/deodorant solid stick package) is provided, portions of which are re-usable, which reduces solid waste and also reduces the cost of package components required for the stick product. The present invention, whereby the cover and/or handle are re-used, can save up to 50% by weight of the plastic utilized in the package. In addition, the product can be provided such that the top surface thereof is comfortable for the consumer to use from the initial use of the product. In addition, removal and/or application of the cover on the remainder of the product package is facilitated.

While I have shown and described several embodiments in accordance with the present invention, it is understood that the same is not limited thereto, but is susceptible of numerous changes and modifications as known to those skilled in the art. Therefore, I do not wish to be limited to the details shown and described herein, but intend to cover all such changes and modifications as are encompassed by the scope of the appended claims.

I claim:

1. A method of hot-filling a solid stick product, comprising the steps of:

assembling a retaining member and a cover together, so as to form an assembly, the retaining member and the cover forming a cavity therebetween to be supplied with molten solid stick product, wherein a surface of the retaining member forming a border of the cavity has retention wells extending thereinto for anchoring solidified product on the retaining member, the solidified product filling the retention wells so as to anchor the solidified product, the retaining member having a fill hole therethrough for filling the product into the cavity, the retention wells having vent channels extending therefrom and extending along the retaining member to a location spaced from the retention wells, so as to remove air, trapped in the retention wells during filling the product into the cavity, to the location spaced from the retention wells, the vent channels being sloped so as to facilitate flow of air from the retention wells in forming the solid stick product to be retained on the retaining member;

inverting the assembly of the retaining member and the covert so that the fill hole opens upwardly;

filling the cavity with molten solid stick product through the fill hole, with air trapped in the retention wells being removed therefrom through the vent channels, the molten solid stick product filling the retention wells during the step of filling the cavity; and cooling the molten product so as to form the solid stick product.

2. A method according to claim 1, wherein, after the molten solid stick product has solidified, a handle is attached to the assembly.

3. A method according to claim 1, wherein the vent channels are formed along said surface of the retaining member forming a border of the cavity, and extend generally in a direction along said surface.

4. A method according to claim 1, wherein the vent channels extend generally in a direction along said surface.

5. A method according to claim 1, wherein, in assembling the retaining member and cover, the cover is directly connected to the retaining member.

6. A method of hot-filling a solid stick product, comprising the steps of:

assembling a retaining member and a cover together, so as to form an assembly, the retaining member and the cover forming a cavity therebetween to be supplied with molten solid stick product, wherein a surface of the retaining member forming a border of the cavity has retention wells extending thereinto for anchoring solidified product on the retaining member, the solidified product filling the retention wells so as to anchor the solidified product, the retaining member having a fill hole therethrough for filling the product into the cavity, the fill hole being spaced from the retention wells, the retention wells having vent channels extending therefrom and extending along the retaining member to said fill hole spaced from the retention wells, so as to remove air, trapped in the retention wells during filling the product into the cavity, to the fill hole spaced from the retention wells, the vent channels being sloped so as to facilitate venting of the air from the retention wells to the fill hole;

inverting the assembly of the retaining member and the cover, so that the fill hole opens upwardly;

filling the cavity with molten solid stick product through the fill hole, with air trapped in the retention wells being displaced from the retention wells through the vent channels to the fill hole, the molten solid stick product filling the retention wells during the step of filling the cavity; and cooling the molten product se as to form the solid stick product.

7. A retaining member for retaining a solid stick product in a solid stick product package, the retaining member having a surface, for supporting the solid stick product, said surface having retention wells extending thereinto for anchoring the solid stick product, the retention wells being adapted to have the solid stick product therein so as to anchor the solid stick product, the retention wells having vent channels extending therefrom and extending along the retaining member, to a location spaced from the retention wells, so as to vent air in the retention wells away from the retention wells to the location spaced from the retention wells, the vent channels being sloped so as to facilitate flow of air from the retention wells in forming the solid stick product to be retained on the retaining member.

8. A retaining member according to claim 7, wherein the surface is outwardly convex.

9. A retaining member according to claim 7, wherein said location has an opening thereat through the retaining member, whereby air from the retention wells can be vented away from the retaining member at a position spaced from the retention wells.

10. A retaining member according to claim 9, wherein the retaining member is adapted to have a cover thereon so as to form a cavity between the surface of the retaining member and the cover, said air being vented away from the cavity through said opening.

11. A retaining member according to claim 7, the retaining member having a first surface for holding a cover to cover the solid stick product.

12. A retaining member according to claim 11, having a second surface for attachment to a handle, said second surface being on a side of the retaining member opposite a side of the retaining member having the first surface.

13. A retaining member according to claim 7, wherein the vent channels are constituted by channels formed along said surface and extending generally in a direction along said surface.

14. A retaining member according to claim 7, wherein the vent channels extend generally in a direction along said surface.

15. A retaining member for retaining a solid stick product in a solid stick product package, the retaining member having a surface, for supporting the solid stick product, said surface having retention wells extending thereinto for anchoring the solid stick product, the retention wells being adapted to have the solid stick product therein so as to anchor the solid stick product, the retaining member having a fill hole extending therethrough, the fill hole being spaced from the retention wells, the retention wells having vent channels extending therefrom and extending along the retaining member, to said fill hole spaced from the retention wells, so as to vent air in the retention wells away from the retention wells to the fill hole spaced from the retention wells, the vent channels being sloped so as to facilitate flow of air from the retention wells to the fill hole in forming the solid stick product to be retained on the retaining member.

16. A retaining member according to claim 15, wherein said fill hole is at a central location of the retaining member, the retention wells being located around the fill hole.

17. A retaining member according to claim 15, wherein at least one of the vent channels extends through two retention wells.

18. A retaining member according to claim 15, wherein the vent channels, at the fill hole, have a depth that is substantially an entire length of the fill hole.

19. A package for a solid stick product, comprising a retaining member for retaining the solid stick product; a cover, detachably connected to the retaining member, for covering the solid stick product; and a handle, attached to the retaining member, wherein the retaining member includes retention wells for providing an anchor for the product to the retaining member, the retention wells being adapted to have said solid stick product therein for providing the anchor, the retention wells having vent channels extending therefrom for evacuating air from the retention wells when product is supplied to a cavity defined between the retaining member and the cover, said vent channels extending from the retention wells and along the retaining member, to a location spaced from the retention wells, so as to vent air in the retention wells away from the retention wells to the location spaced from the retention wells, the vent channels being sloped so as to facilitate flow of air from the retention wells in forming the solid stick product to be retained on the retaining member.

20. A packaged solid stick product comprising a solid stick product retained in said package of claim 19, the solid stick product being retained on said retaining member, with solid stick product being provided in the retention wells.

21. A packaged solid stick product according to claim 20, wherein said solid stick product is a deodorant stick product for application to axillary regions of a human.

22. A package for a solid stick product according to claim 19, wherein the retaining member has a fill hole for supplying molten material, for forming the solid stick product, into the cavity defined between the cover and the retaining member.

23. A package for a solid stick product according to claim 22, wherein said fill hole is a single fill hole located at a central portion of the retaining member.

24. A package for a solid stick product according to claim 23, wherein the vent channels extend from the retention wells to the fill hole in the retaining member.

25. A package for a solid stick product according to claim 19, wherein at least one of the vent channels extends through two retention wells.

26. A package for a solid stick product according to claim 19, wherein said cover extends away from one side of the retaining member, and the handle extends away from a second side of the retaining member opposite said one side.

27. A package for a solid stick product according to claim 19, wherein said location has an opening thereat through the retaining member, whereby air from the retention wells can be vented away from the retaining member at a position spaced from the retention wells.

28. A package for a solid stick product according to claim 19, wherein the retaining member has a surface on which the solid stick product is to be retained, and wherein the vent channels are constituted by channels formed along said surface and extending generally in a direction along said surface.

29. A package for a solid stick product according to claim 19, wherein the retaining member has a surface on which the solid stick product is to be retained, and wherein the vent channels extend generally in a direction along said surface.

30. A package for a solid stick product according to claim 19, wherein the cover is directly connected to the retaining member, and wherein the handle is also directly connected to the retaining member.

31. A package for a solid stick product according to claim 19, wherein the retaining member is adapted to fixedly hold the solid stick product exposed for use, whereby the package does not include an elevator structure for exposing the solid stick product.

32. A package for a solid stick product, comprising a retaining member for retaining the solid stick product; a cover, detachably connected to the retaining member, for covering the solid stick product; and a handle attached to the retaining member, wherein the retaining member includes retention wells for providing an anchor for the product to the retaining member, the retention wells being adapted to have said solid stick product therein for providing the anchor, the retaining member having a fill hole extending therethrough, the fill hole being spaced from the retention wells, the retention wells having vent channels extending therefrom for evacuating air from the retention wells when product is supplied to a cavity defined between the retaining member and the cover, said vent channels extending from the retention wells and along the retaining member, to said fill hole spaced from the retention wells, so as to vent air in the retention wells away from the retention wells to the fill hole spaced from the retention wells, the vent channels being sloped so as to facilitate flow of air from the retention wells to the fill hole in forming the solid stick product to be retained on the retaining member.

33. A packaged solid stick product comprising a solid stick product retained in said package of claim 32, the solid stick product being retained on said retaining member, the solid stick product being provided in the retention wells.

34. A packaged solid stick product according to claim 33, wherein said solid stick product is a deodorant stick product for application to axillary regions of a human.

* * * * *